US009307606B2

(12) United States Patent
Wu et al.

(10) Patent No.: US 9,307,606 B2
(45) Date of Patent: Apr. 5, 2016

(54) LIGHT EMITTING DEVICE DRIVER CIRCUIT AND CONTROL CIRCUIT AND CONTROL METHOD THEREOF

(71) Applicants: Chang-Yu Wu, Zhubei (TW); Wei-Ming Chiu, Zhubei (TW)

(72) Inventors: Chang-Yu Wu, Zhubei (TW); Wei-Ming Chiu, Zhubei (TW)

(73) Assignee: RICHTEK TECHNOLOGY CORPORATION, Zhubei, Hsinchu (TW)

( * ) Notice: Subject to any disclaimer, the term of this patent is extended or adjusted under 35 U.S.C. 154(b) by 0 days.

(21) Appl. No.: 14/792,909

(22) Filed: Jul. 7, 2015

(65) Prior Publication Data

US 2016/0021715 A1 Jan. 21, 2016

Related U.S. Application Data

(60) Provisional application No. 62/025,275, filed on Jul. 16, 2014.

(51) Int. Cl.
*H05B 33/08* (2006.01)

(52) U.S. Cl.
CPC ..... *H05B 33/0851* (2013.01); *H05B 33/0818* (2013.01)

(58) Field of Classification Search
USPC ..... 315/200 R–312
See application file for complete search history.

(56) References Cited

U.S. PATENT DOCUMENTS

2011/0115399 A1* 5/2011 Sadwick ..... H05B 33/0818 315/287
2015/0264755 A1* 9/2015 Hsia ..... H05B 33/0815 315/294

* cited by examiner

*Primary Examiner* — Douglas W Owens
*Assistant Examiner* — Jonathan Cooper
(74) *Attorney, Agent, or Firm* — Tung & Associates

(57) ABSTRACT

The present invention provides a light emitting device driver circuit and a control circuit and a control method thereof. The light emitting device driver circuit is used for driving a light emitting device circuit according to a rectified dimming signal. The light emitting device driver circuit includes a power stage circuit and a control circuit. The control circuit includes a pulse width modulation (PWM) circuit, a current limit (CL) circuit, and a determination circuit. The CL circuit generates a CL signal according to a current sense signal and a predetermined CL threshold. The determination circuit is coupled to the PWM circuit and the CL circuit, for generating an operation signal according to a PWM signal and the CL signal. The power stage circuit maintains an absolute level of an AC dimming current not lower than a holding current in an ON phase period.

17 Claims, 9 Drawing Sheets

LIGHT EMITTING DEVICE DRIVER CIRCUIT AND CONTROL CIRCUIT AND CONTROL METHOD THEREOF

CROSS REFERENCE

The present invention claims priority to U.S. provisional application No. 62/025,275, filed on Jul. 16, 2014.

BACKGROUND OF THE INVENTION

1. Field of Invention

The present invention relates to a light emitting device driver circuit and a control circuit and a control method thereof. Particularly, it relates to such light emitting device driver circuit and control circuit and control method thereof which improve a dimmable range of the light emitting device circuit.

2. Description of Related Art

FIG. 1A shows a schematic diagram of a prior art light emitting diode (LED) power supply circuit 10. As shown in FIG. 1A, the LED power supply circuit 10 includes a tri-electrode AC switch (TRIAC) dimming circuit 11, a rectifier circuit 13, an LED driver circuit 15, and a bleeder circuit 17. The TRIAC dimming circuit 11 receives an AC signal AC and outputs an AC dimming signal AC1'. When the AC signal exceeds a trigger phase, the TRIAC dimming circuit 11 fires (starts-up) and is turned ON. FIG. 1B shows a schematic diagram of waveforms of an AC voltage ACV and an AC dimming voltage ACV1', wherein the AC signal includes the AC voltage ACV, and the AC dimming signal AC1' includes the AC dimming voltage ACV1'. The AC voltage ACV is shown by a dashed line, and the AC dimming voltage ACV1' generated by the TRIAC dimming circuit 11 is shown by a solid line. The TRIAC dimming circuit 11 is triggered at the trigger phase, and is turned ON for an ON phase period ONPP, whereas the period in which the TRIAC dimming circuit 11 is turned OFF is an OFF phase period OFFPP. The rectifier circuit 13 receives the AC dimming signal AC1', and rectifies it to generate a rectified dimming signal, which includes a rectified dimming current Ir1'. The rectified dimming current Ir1' is divided to an input current Iin1 flowing through the LED driver circuit 15, and a bleeding current Ibld flowing through the bleeder circuit 17. The LED driver circuit 15 converts a rectified dimming voltage Vin to an output voltage Vout which is provided to the LED circuit 20. In the aforementioned circuit, the TRIAC dimming circuit 11 functions to determine the trigger phase of the AC dimming voltage ACV1', so as to adjust an average brightness of the LED circuit 20. The LED driver circuit 15 includes a power stage circuit which has at least one power switch. The power stage circuit may be a synchronous or asynchronous buck, boost, inverting, buck-boost, inverting-boost, or flyback power stage circuit as shown in FIGS. 6A-6K.

One of the drawbacks of the aforementioned prior art is that the TRIAC dimming circuit 11 includes a TRIAC device which requires a large latching current to fire (start-up), and after the LED circuit 20 is turned ON in the ON phase period ONPP, it is required for the current flowing through the TRIAC device to have an absolute level higher than a holding current in order to keep the TRIAC dimming circuit 11 in a normal operation. If what the power supply drives is a high power consuming load circuit, such as a conventional incandescent lamp, the latching current and the holding current for the TRIAC device is sufficient. However if what the power supply drives is a low power consuming load circuit, such as the LED circuit 20, the latching current and the holding current for the TRIAC device is insufficient because of the low current of the LED circuit 20. If the power supply circuit does not generate a sufficient latching current to fire the TRIAC device or the holding current to keep it operating normally, a so-called "misfire" occurs and the LED circuit 20 will flicker perceptibly, or a dimming range of the LED circuit 20 is limited. In this regard, FIG. 1C shows the waveforms of the AC voltage ACV and the AC dimming voltage ACV1' when the misfire condition occurs. On the other hand, even though the latching current is sufficient to fire the TRIAC device, the misfire may still occurs or the dimming range of the LED circuit 20 is limited if the AC current of the AC signal flowing through the TRIAC device is too low, for example when the trigger phase is too high (late) such that the absolute level of the AC current flowing through the TRIAC dimming circuit 11 is lower than the holding current.

FIGS. 1D and 1E show schematic diagrams of signal waveforms of an input current Iin1, the bleeding current Ibld, and the rectified dimming current Ir1', which illustrates how the bleeder circuit 17 maintains the absolute level of the AC current flowing through the TRIAC dimming circuit 11 to be higher than the holding current. The bleeder circuit 17 is coupled between the rectifier circuit 13 and the LED driver circuit 15, for generating a sufficient latching current periodically to trigger the TRIAC device in the TRIAC dimmer circuit 11, and maintaining the absolute level of the AC current flowing through the TRIAC dimming circuit 11 to be higher than the holding current. The bleeding current Ibld must not be lower than the holding current, such that the TRIAC dimming circuit 11 can operate normally.

Although the prior art shown in FIG. 1A mitigates the problem of flickering and improves the dimming range, it still has several drawbacks. First, the TRIAC dimming circuit 12 can not perform full range dimming; the trigger phase can not be higher (later) than a specific phase because of the bleeder circuit 17. Second, the bleeding current generated by the bleeder circuit 17 is consumed unproductively; it is wasted because it does not flow through the LED circuit 20, and it may also cause an overheat problem. Third the prior art requires a large circuitry size because of the bleeder circuit 17.

In view of the foregoing, the present invention provides a light emitting device driver circuit and a control circuit and a control method thereof. In the present invention, the absolute level of the AC dimming current is maintained not lower than the holding current by the control circuit which generates the operation signal to operate at least one power switch of the power stage circuit.

SUMMARY OF THE INVENTION

From one perspective, the present invention provides a light emitting device driver circuit for driving a light emitting device circuit according to a rectified dimming signal, wherein a phase-cut dimming circuit converts an AC signal to an AC dimming signal, and a rectifier circuit converts the AC dimming signal to the rectified dimming signal, the light emitting device driver circuit comprising: a power stage circuit, which is coupled to the rectifier circuit, for operating at least one power switch therein according to an operation signal, to convert the rectified dimming signal to an output signal, for driving the light emitting device circuit; and a control circuit, for generating the operation signal according to a current sense signal related to a current flowing through the power switch, and a feedback signal related to the output signal, the control circuit including: a pulse width modulation (PWM) circuit, for generating a PWM signal according to a level of the feedback signal; a current limit (CL) circuit, for generating a CL signal according to the current sense signal and a predetermined current threshold, wherein the CL signal indicates whether the current sense signal reaches the predetermined current threshold; and a determination circuit, which is coupled to the PWM circuit and the CL circuit, for generating the operation signal, and determining a duty of the operation signal according to one of the PWM signal and the CL signal; wherein the power stage circuit operates the power switch according to the operation signal, to maintain an absolute level of an AC dimming current not lower than a holding current in an ON phase period; wherein the operation signal is generated for a plurality of times in the ON phase period, wherein the duty of the operation signal in a portion of the times is decided by the PWM signal, and the duty of the operation signal in another portion of the times is determined by the CL signal; wherein the AC dimming signal includes the AC dimming current flowing through the phase-cut dimming circuit, and the phase-cut dimming circuit blocks an OFF phase period of the AC signal and retains the ON phase period of the AC signal, to generate the AC dimming signal.

In one preferable embodiment, the determination circuit includes: a logic gate circuit, which is coupled to the PWM circuit and the CL circuit, for generating a reset signal according to the PWM signal and the CL signal; and a flip-flop circuit, which is coupled to the logic gate circuit, for generating the control signal according to the reset signal and a set signal, wherein the set signal is related to a clock signal or the feedback signal; wherein a start time point of the duty of the operation signal is determined by the set signal, and an end time point of the duty of the operation signal is determined by the reset signal.

In one preferable embodiment, the PWM circuit includes: an error amplifier circuit, for generating an error amplified signal according to the feedback signal and a reference signal; and a comparison circuit, which is coupled to the error amplifier circuit, for generating the PWM signal according to the error amplified signal and a ramp signal.

In one preferable embodiment, the light emitting device driver circuit is not connected to a bleeder circuit in parallel, wherein the bleeder circuit is for consuming a bleeding current which does not flow through the light emitting device circuit to maintain the absolute level of the AC dimming current not lower than the holding current in the ON phase period.

In one preferable embodiment, the CL signal is for maintaining the absolute level of the AC dimming current not lower than the holding current in the ON phase period.

In one preferable embodiment, the power stage circuit includes: a first winding, which is coupled to the rectifier circuit and the power switch, for receiving the rectified dimming signal and determining a switch current flowing through the power switch according to operation of the power switch; a second winding, which is coupled to the first winding, for generating the output signal according to the rectified dimming signal and the switch current, the output signal being provided to the light emitting device circuit; and a third winding, which is coupled to the second winding, for generating a sense signal according to the output signal.

In the aforementioned embodiment, the first winding and the second winding are preferably connected in series, to form a tapped inductor.

In the aforementioned embodiment, the power stage circuit preferably further includes a voltage divider circuit, which is coupled to the third winding, for obtaining a divided voltage of the sense signal to generate the feedback signal.

From another perspective, the present invention provides a control method of a light emitting device driver circuit, wherein the light emitting device driver circuit is for driving a light emitting device circuit according to a rectified dimming signal, wherein a phase-cut dimming circuit converts an AC signal to an AC dimming signal, and a rectifier circuit converts the AC dimming signal to the rectified dimming signal, the control method comprising: operating at least one power switch according to an operation signal, to convert the rectified dimming signal to an output signal, for driving the light emitting device circuit, and to maintain an absolute level of an AC dimming current not lower than a holding current in an ON phase period; generating a PWM signal according to a level of a feedback signal related to the output signal; generating a current limit (CL) signal according to a current sense signal and a predetermined current threshold, the current sense signal being related to a current flowing thorough the power switch, wherein the CL signal indicates whether the current sense signal reaches the predetermined current threshold; and generating the operation signal according to the PWM signal and the CL signal, and determining a duty of the operation signal according to one of the PWM signal and the CL signal; wherein the operation signal is generated for a plurality of times in the ON phase period, wherein the duty of the operation signal in a portion of the times is decided by the PWM signal, and the duty of the operation signal in another portion of the times is determined by the CL signal; wherein the AC dimming signal includes the AC dimming current flowing through the phase-cut dimming circuit, and the phase-cut dimming circuit blocks an OFF phase period of the AC signal and retains the ON phase period of the AC signal, to generate the AC dimming signal.

In one preferable embodiment, the step of generating the operation signal according to the PWM signal and the CL signal includes: generating a reset signal by performing a logic operation of the PWM signal and the CL signal; and inputting the reset signal and a set signal to a flip-flop circuit, to generate the control signal, wherein the set signal is related to a clock signal or the feedback signal; wherein a start time point of the duty of the operation signal is determined by the set signal, and an end time point of the duty of the operation signal is determined by the reset signal.

In one preferable embodiment, the step of generating a PWM signal according to a level of a feedback signal related to the output signal includes: comparing the feedback signal and a reference signal, or a signal related to the feedback signal and a reference signal, to generate an error amplified signal; and comparing the error amplified signal and a ramp signal to generate the PWM signal.

In one preferable embodiment, the current limit (CL) signal is for maintaining the absolute level of the AC dimming current not lower than the holding current in the ON phase period.

From another perspective, the present invention provides a control circuit of a light emitting device driver circuit, wherein the light emitting device driver circuit is for driving a light emitting device circuit according to a rectified dimming signal, wherein a phase-cut dimming circuit converts an AC signal to an AC dimming signal, and a rectifier circuit converts the AC dimming signal to the rectified dimming signal, wherein the light emitting device driver circuit includes a power stage circuit and the control circuit, wherein the power stage circuit is coupled to the rectifier circuit, for operating at least one power switch therein according to an operation signal, to convert the rectified dimming signal to an output signal, for driving the light emitting device circuit, the control circuit generating the operation signal according to a current sense signal and a feedback signal, wherein the current sense signal is related to a current flowing through the power switch, and the feedback signal is related to the output signal, the control circuit comprising: a pulse width modulation (PWM) circuit, for generating a PWM signal according to a level of the feedback signal; a current limit (CL) circuit, for generating a CL signal according to the current sense signal and a predetermined current threshold, wherein the CL signal indicates whether the current sense signal reaches the predetermined current threshold; and a determination circuit, which is coupled to the PWM circuit and the CL circuit, for generating the operation signal, and determining a duty of the operation signal according to one of the PWM signal and the CL signal; wherein the power stage circuit operates the power switch according to the operation signal, to maintain an absolute level of an AC dimming current not lower than a holding current in an ON phase period; wherein the operation signal is generated for a plurality of times in the ON phase period, wherein the duty of the operation signal in a portion of the times is decided by the PWM signal, and the duty of the operation signal in another portion of the times is determined by the CL signal; wherein the AC dimming signal includes the AC dimming current flowing through the phase-cut dimming circuit, and the phase-cut dimming circuit blocks an OFF phase period of the AC signal and retains the ON phase period of the AC signal, to generate the AC dimming signal.

In one preferable embodiment, the determination circuit includes: a logic gate circuit, which is coupled to the PWM circuit and the CL circuit, for generating a reset signal according to the PWM signal and the CL signal; and a flip-flop circuit, which is coupled to the logic gate circuit, for generating the control signal according to the reset signal and a set signal, wherein the set signal is related to a clock signal or the feedback signal; wherein a start time point of the duty of the operation signal is determined by the set signal, and an end time point of the duty of the operation signal is determined by the reset signal.

In one preferable embodiment, the PWM circuit includes: an error amplifier circuit, for generating an error amplified signal according to the feedback signal and a reference signal; and a comparison circuit, which is coupled to the error amplifier circuit, for generating the PWM signal according to the error amplified signal and a ramp signal.

In one preferable embodiment, the light emitting device driver circuit is not connected to a bleeder circuit in parallel, wherein the bleeder circuit is for consuming a bleeding current which does not flow through the light emitting device circuit to maintain the absolute level of the AC dimming current not lower than the holding current in the ON phase period.

In one preferable embodiment, the current limit (CL) signal is for maintaining the absolute level of the AC dimming current not lower than the holding current in the ON phase period.

The objectives, technical details, features, and effects of the present invention will be better understood with regard to the detailed description of the embodiments below.

DESCRIPTION OF THE PREFERRED EMBODIMENTS

The drawings as referred to throughout the description of the present invention are for illustration only, to show the interrelations between the circuits and the signal waveforms, but not drawn according to actual scale.

Figure 2A:
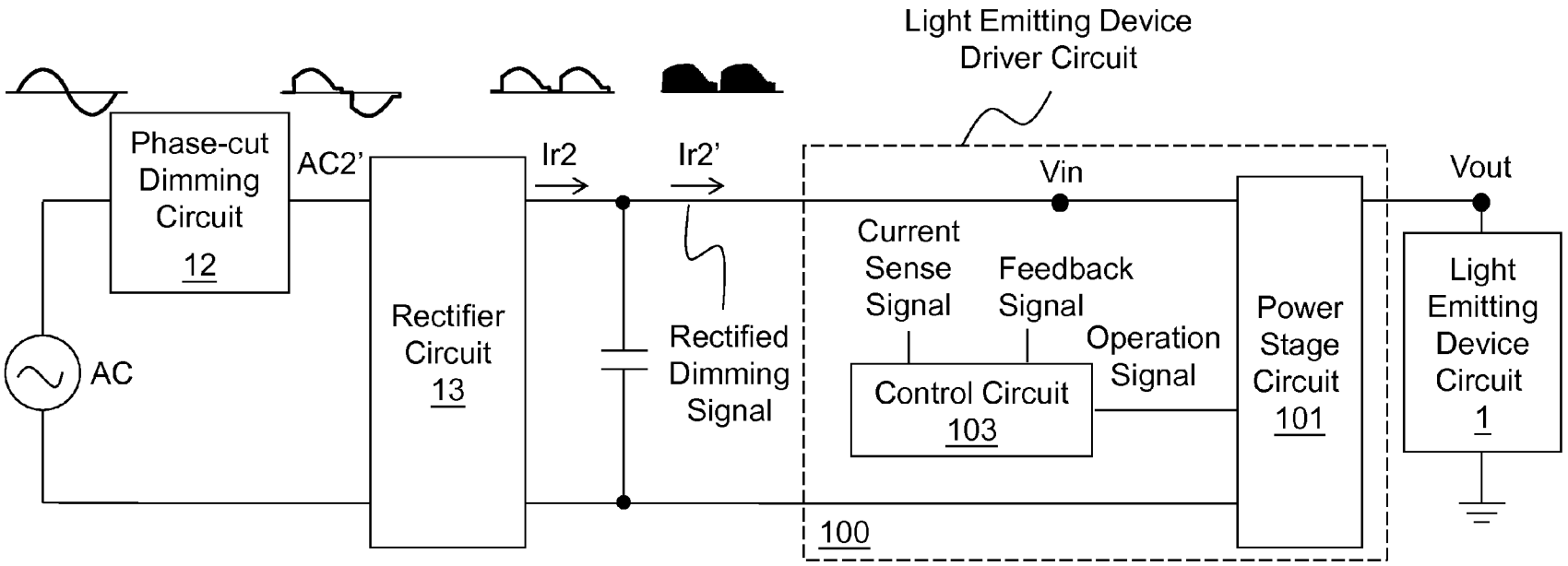
FIGS. 2A-2C show a first embodiment of the present invention.
Figure 2B:
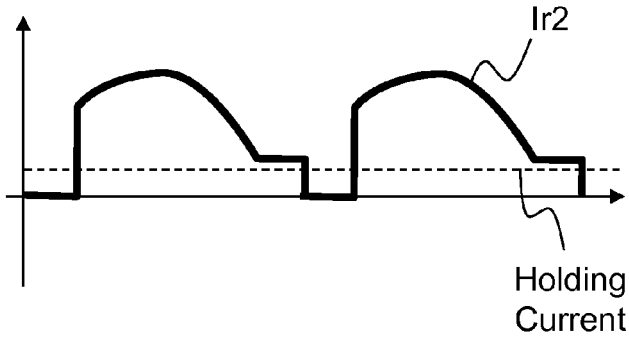
Figure 2C:
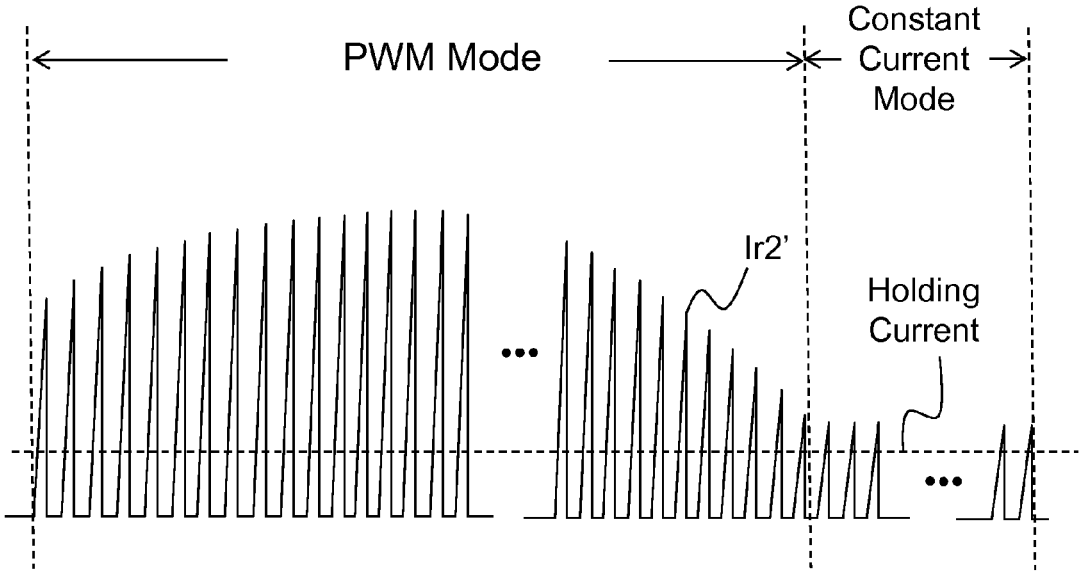

FIGS. 2A-2C show a first embodiment of the present invention. As shown in FIG. 2A, alight emitting device driver circuit 100 drives a light emitting device circuit 1 according to a rectified dimming signal. A phase-cut dimming circuit 12 converts an AC signal to an AC dimming signal AC2', wherein the phase-cut dimming circuit 12 is for example but not limited to the prior art TRIAC dimming circuit 11. The AC dimming signal AC2' includes an AC dimming current flowing through the phase-cut dimming circuit 12. The phase-cut dimming circuit 12 blocks an OFF phase period OFFPP of the AC signal (as shown by the prior art OFF phase period OFFPP), and retains an ON phase period ONPP (as shown by the prior art ON phase period ONPP) of the AC signal, to generate the AC dimming signal AC2'. The rectifier circuit 13 converts the AC dimming signal AC2' to the rectified dimming signal, wherein the rectifier circuit 13 is for example but not limited to abridge rectifier circuit, and the rectifier circuit 13 can optionally include or cooperate with a low-pass filter (LPF) circuit or a power factor correction (PFC) circuit, as well known by those skilled in the art, so details thereof are omitted here. The light emitting device driver circuit 100 includes a power stage circuit 101 and a control circuit 103. The power stage circuit 101 is coupled to the rectifier circuit 13, for operating at least one power switch therein according to an operation signal, to convert the rectified dimming signal to an output signal, for driving the light emitting device circuit 1. The rectified dimming signal includes a rectified dimming current Ir2' and a rectified dimming voltage Vin, and the output signal includes an output voltage Vout. The power stage circuit 101 may be a synchronous or asynchronous buck, boost, inverting, buck-boost, inverting-boost, or flyback power stage circuit as shown in FIGS. 6A-6K.

The control circuit 103 is for generating the operation signal according to a current sense signal and a feedback signal, wherein the current sense signal is related to a current flowing through the power switch, for example but not limited to a sensed value of the current, and the feedback signal is related to the output signal, for example but not limited to a sensed value of the output signal. The power stage circuit 101 operates the power switch according to the operation signal, to maintain an absolute level of the aforementioned AC dimming current not lower than a holding current in an ON phase period ONPP. Note that as the rectifier circuit 13 converts the AC dimming signal AC2' to the rectified dimming signal, the rectified dimming current Ir2' of the rectified dimming signal is affected by the switching of the power switch of the power stage circuit 101, so it has a signal waveform with a high frequency carrier wave as shown in FIG. 2C, whereas the rectified dimming filtered current Ir2 is affected by the capacitor shown in FIG. 2A, and by the filtering effect of the capacitor, the rectified dimming filtered current Ir2 has a smooth signal waveform as shown in FIG. 2B.

Figure 1A:
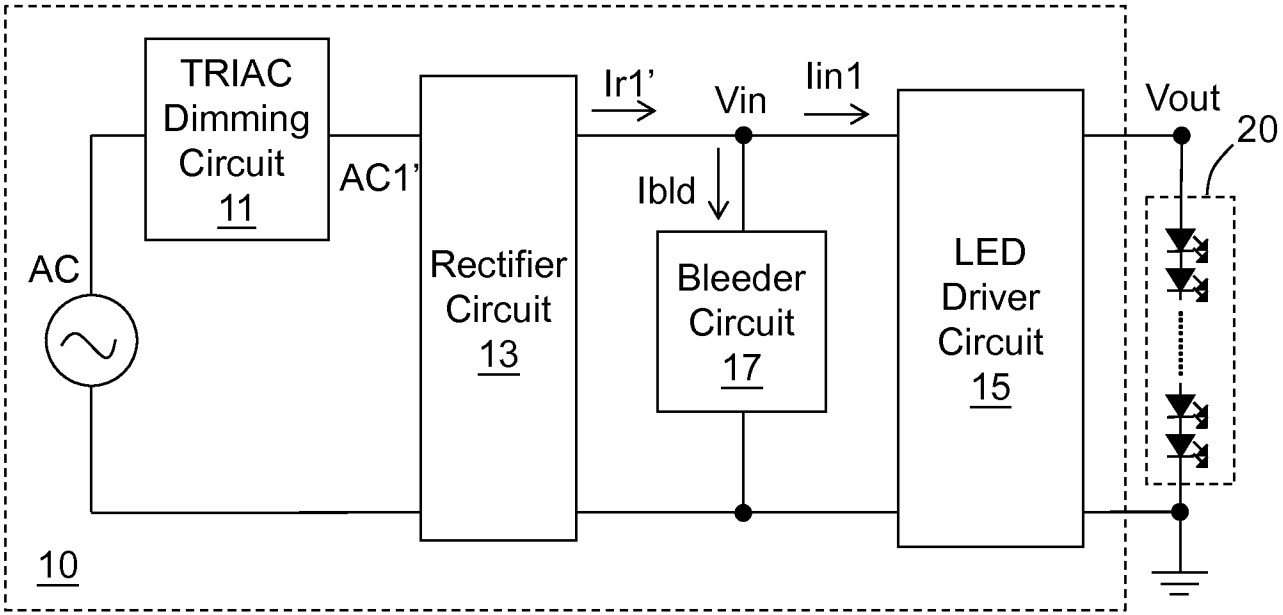
Fig. 1A (Prior Art)
FIG. 1A shows a schematic diagram of a prior art light emitting diode (LED) power supply circuit 10.
Figure 1B:
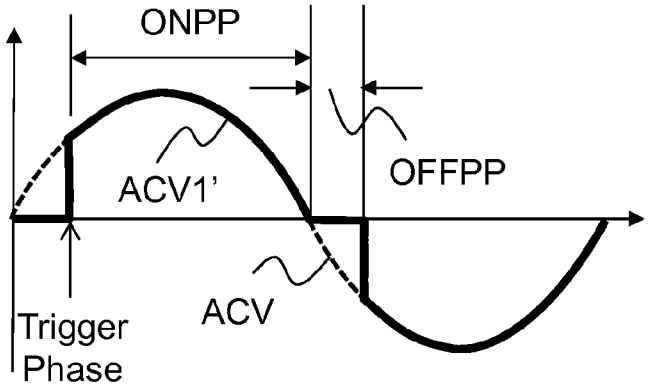
Fig. 1B (Prior Art)
FIGS. 1B and 1C show waveforms of the AC voltages AC and the AC dimming voltages ACV1' with sufficient and insufficient latching current for firing the TRIAC device, respectively.
Figure 1C:
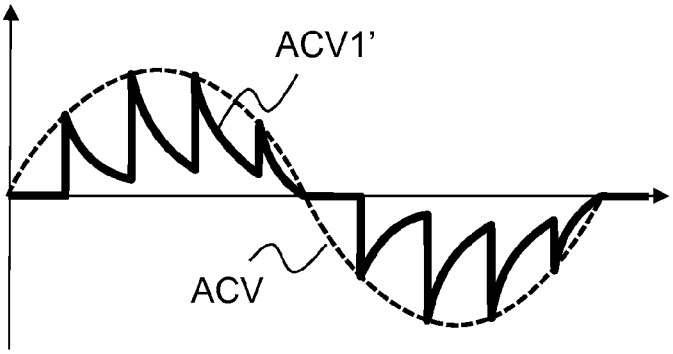
Fig. 1C (Prior Art)
Figure 1D:
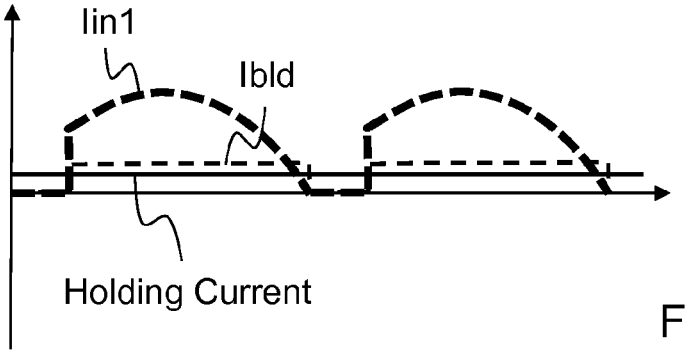
Fig. 1D (Prior Art)
FIGS. 1D and 1E show schematic diagrams of signal waveforms of the input current Iin1, the bleeding current Ibld, and the rectified dimming current Ir1'.
Figure 1E:
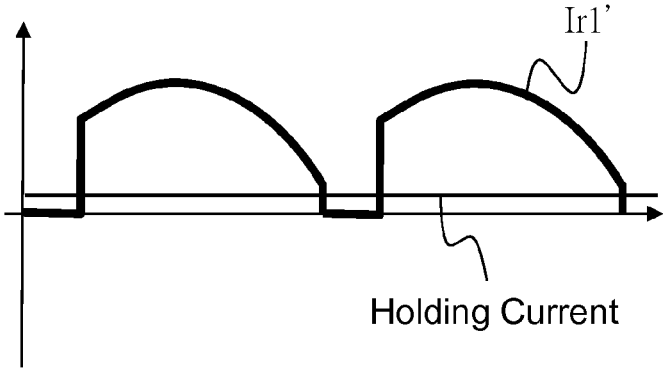
Fig. 1E (Prior Art)

Please refer to FIG. 2B, which shows a schematic diagram of the signal waveform of the rectified dimming filtered current Ir2 according to the present invention. The present invention maintains the rectified dimming filtered current Ir2 not lower than the holding current by the operation of the light emitting device driver circuit 100 without requiring a bleeder circuit; the light emitting device driver circuit 100 generates the operation signal according to the current sense signal and the feedback signal, whereby when the power stage circuit 101 operates the power switch according to the operation signal, the aforementioned absolute level of the AC dimming current is not lower than the holding current in the ON phase period ONPP. More specifically, in the prior art shown in FIG. 1A, the current flowing through the TRIAC device is maintained higher than the holding current by the bleeder circuit 17 which generates the bleeding current in the ON phase period ONPP of every AC period. In contrast, according to the present invention, the rectified dimming filtered current Ir2 is maintained not lower than the holding current by providing a well-controlled operation signal, which operates the power switch such that the absolute level of the AC dimming current flowing through the phase-cut dimming circuit 12 is not lower than the holding current. Compared to the prior art, the present invention does not need the bleeder circuit 17, that is, the light emitting device driver circuit according to the present invention does not have to be connected to a bleeder circuit 17 in parallel (the bleeder circuit 17 is for consuming a bleeding current Ibld in the ON phase period ONPP such that the absolute level of the AC dimming current is not lower than the holding current in the ON phase period ONPP, wherein the bleeding current Ibld does not flow through the light emitting device circuit). Therefore, according to the present invention, the power consumed for maintaining the absolute level of the AC dimming current flowing through the phase-cut dimming circuit 12 not lower than the holding current is not wasted in the bleeder circuit, but is consumed by the light emitting device circuit 1 instead, so the power utilization efficiency is better. In addition, the present invention also mitigates the overheat problem, and saves the space of the circuitry.

FIG. 2C shows a schematic diagram of the signal waveform of the rectified dimming current Ir2'. According to the present invention, the operation signal switches the power switch by a frequency of thousands Hz to millions Hz, so from a microcosmic perspective, the rectified dimming current Ir2' has a signal waveform with the high frequency carrier wave as shown in FIG. 2C. The rectified dimming filtered current Ir2 is affected by the filtering effect of the capacitor shown in FIG. 2A, so the rectified dimming filtered current Ir2 has a smooth signal waveform as shown in FIG. 2B. The above are well known by those skilled in the art, so details thereof are omitted here.

As shown in FIG. 2C, the rectified dimming current Ir2' is divided to two phase periods of a PWM mode and a constant current mode in one AC period. The light emitting device driver circuit 100 changes the operation mode from the PWM mode to the constant current mode when the rectified dimming filtered current Ir2 is about to be (but not yet) lower than the holding current, such that the absolute level of the AC dimming current can be maintained higher than the holding current in the ON phase period to keep the phase-cut dimming circuit 12 operating normally. Correspondingly, the control circuit 103 generates the operation signal multiple times in the ON phase period ONPP, wherein the operation signal is generated by the PWM mode in a portion of the multiple times, and the operation signal is generated by the constant current mode in another portion of the multiple times. In the PWM mode, the duty of the operation signal is determined by a PWM signal, and in the constant current mode, the duty of the operation signal is determined by whether the current sense signal reaches a predetermined current threshold (to be described in detail later).

Figure 3:
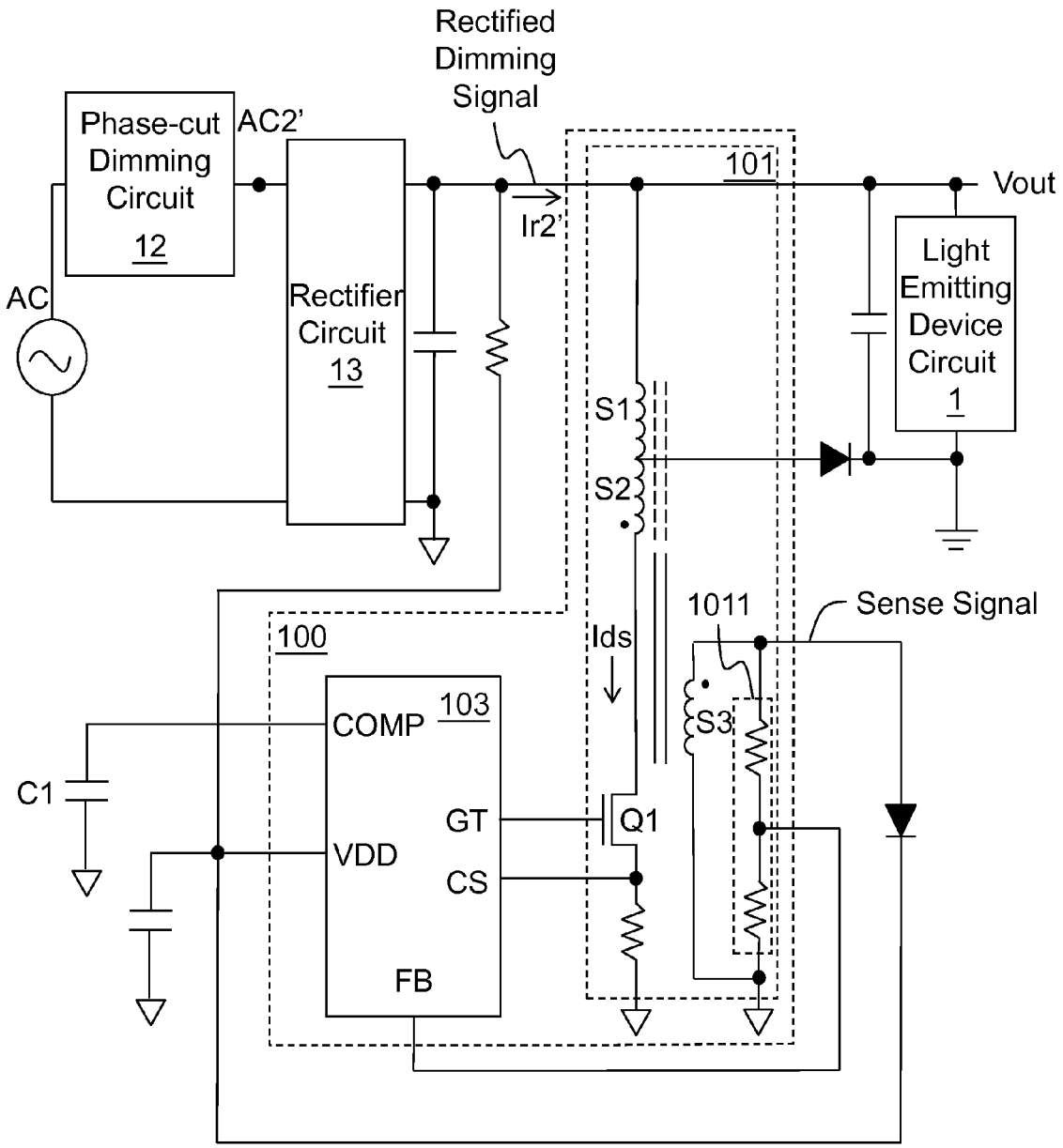
FIG. 3 shows a second embodiment of the present invention.

FIG. 3 shows a second embodiment of the present invention. This embodiment shows a more specific embodiment of the light emitting device driver circuit 100. As shown in the figure, the power stage circuit 101 for example includes a first winding S1, a second winding S2, a third winding S3, and a power switch Q1. The first winding S1 is coupled to the rectifier circuit 13 and the power switch Q1, for receiving the rectified dimming signal and determining a switch current Ids flowing through the power switch Q1 according to the operation of the power switch Q1. The second winding S2 is coupled to the first winding S1, for generating the output signal including the output voltage Vout which is provided to the light emitting device circuit 1, according to the rectified dimming signal and the switch current Ids. The third winding S3 is coupled to the second winding S2, for generating a sense signal according to the output signal. As shown in the figure, in one non-limiting embodiment, the first winding S1 and the second winding S2 are connected in series, to form a tapped inductor.

In one embodiment, as shown in FIG. 3, the third winding S3 generates the sense signal according to the output voltage Vout. The power stage circuit 101 further includes a voltage divider circuit 1011, which is coupled to the third winding S3, for obtaining a divided voltage of the sense signal to generate the feedback signal FB. The control circuit 103 receives a current sense signal CS which is related the switch current Ids. The current sense signal CS is for example but not limited to a voltage signal across a resistor through which the switch current Ids flows, as shown in the figure. An error amplified signal COMP is related to the feedback signal FB, and will be described in detail later. An internal voltage VDD is used for supplying power to the control circuit 103, as well known by those skilled in the art, so details thereof are omitted here.

Figure 4A:
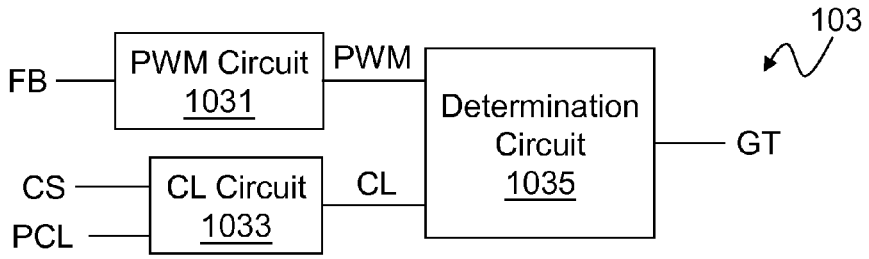
FIG. 4A shows a third embodiment of the present invention.

FIG. 4A shows a third embodiment of the present invention. This embodiment shows a more specific embodiment of the control circuit 103. As shown in FIG. 4A, the control circuit 103 includes a pulse width modulation (PWM) circuit 1031, a current limit (CL) circuit 1033, and a determination circuit 1035. The PWM circuit 1031 is for generating a PWM signal according to a level of the feedback signal FB. The CL circuit 1033 is for generating a CL signal according to whether the current sense signal CS reaches a predetermined current threshold PCL. The determination circuit 1035 is coupled to the PWM circuit 1031 and the CL circuit 1033, for generating an operation signal GT according to the PWM signal and the CL signal, wherein the determination circuit 1035 determines the duty of the operation signal GT according to one of the PWM signal and the CL signal. The power stage circuit 101 operates the power switch Q1 according to the operation signal GT to maintain the absolute level of the AC dimming current not lower than the holding current in the ON phase period ONPP.

Figure 4B:
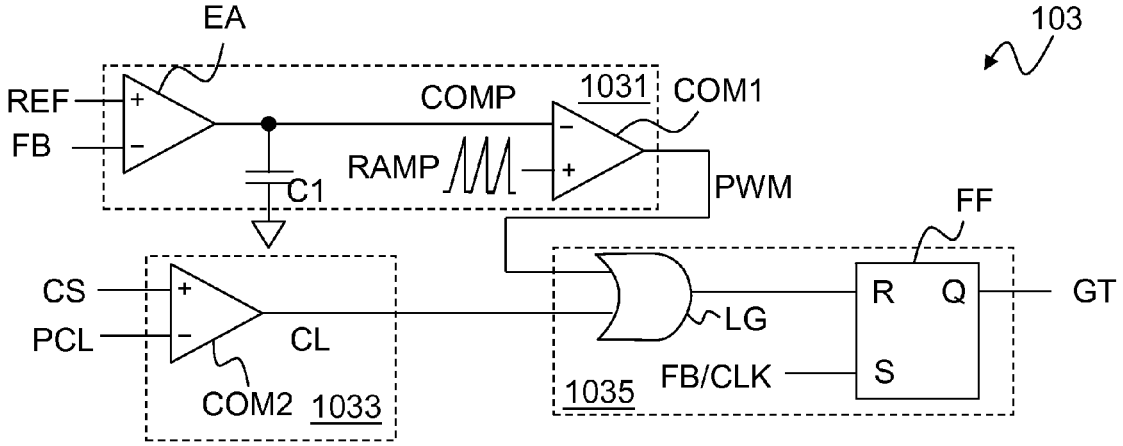
FIG. 4B shows a more specific embodiment of the third embodiment.

FIG. 4B shows a more specific embodiment of the third embodiment of the present invention. The PWM circuit 1031 for example includes an error amplifier circuit EA and a comparison circuit COM1. The error amplifier circuit EA is for generating the error amplified signal COMP according to the feedback signal FB and a reference signal REF. As shown in the figure, the error amplifier circuit EA compares the feedback signal FB (or its related signal, for example but not limited to a signal which is proportional to the feedback signal FB) with the reference signal REF. The output of the error amplifier circuit EA is coupled to a capacitor C1, for generating the error amplified signal COMP which is filtered by the capacitor C1. The comparison circuit COM1 is coupled to the error amplifier circuit EA, for generating the PWM signal according to the error amplified signal COMP and a ramp signal RAMP. On the other hand, the CL circuit 1033 for example includes a comparison circuit COM2. The CL circuit 1033 is for comparing the current sense signal CS with the predetermined current threshold PCL, and generating the CL signal according to the comparison result.

Still referring to FIG. 4B, the determination circuit 1035 includes for example but not limited to a logic gate circuit LG and a flip-flop circuit FF. The logic gate circuit LG is for example but not limited to an OR gate as shown in the figure. The logic gate circuit LG is coupled to the PWM circuit 1031 and the CL circuit 1033, for generating a reset signal R according to one of the PWM signal and the CL signal. The flip-flop circuit FF is coupled to the logic gate circuit LG, for generating a control signal Q according to the reset signal R and a set signal S. The control signal Q for example can be amplified to become the operation signal GT, or directly used as the operation signal GT, depending on the required level to drive the power switch; a start time point of the duty of the operation signal GT is determined by the set signal S, and an end time point of the duty of the operation signal GT is determined by the reset signal S. The set signal S is for example a clock signal CLK, or the feedback signal FB or its related signal. The operation mechanism of the flip-flop circuit FF is well known by those skilled in the art, so details thereof are omitted here. Thus, in the ON phase period ONPP, the duty of the operation signal GT is determined by the PWM signal in the PWM mode; and the duty of the operation signal GT is determined by the CL signal in the constant current mode. Accordingly, the rectified dimming filtered current Ir2 is maintained not lower than the holding current, such that the absolute level of the AC dimming current is not lower than the holding current in the ON phase period ONPP.

Figure 5A:
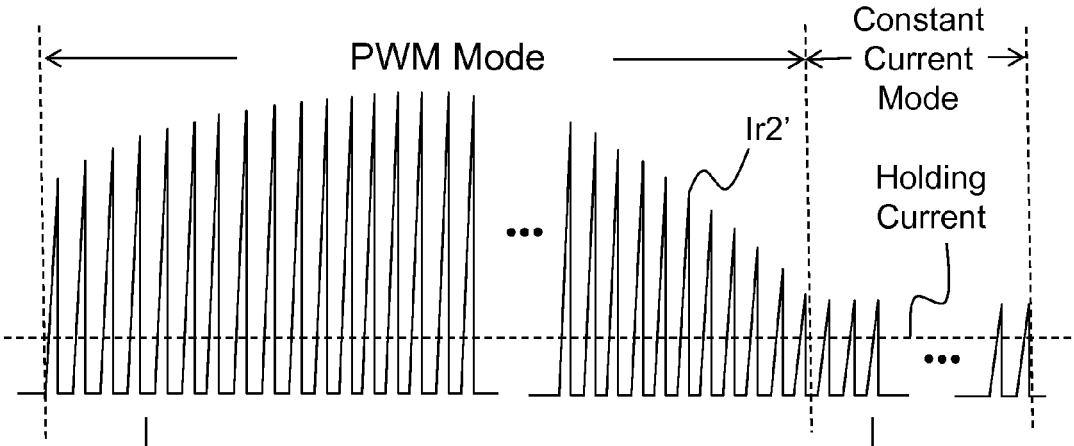
FIGS. 5A-5E shows waveforms of signals in a PWM mode and a constant current mode.
Figure 5B:
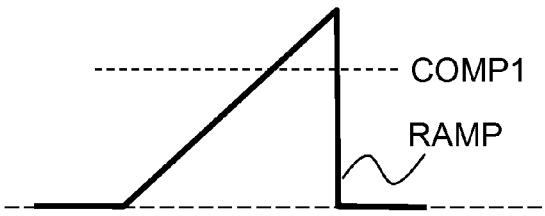
Figure 5D:
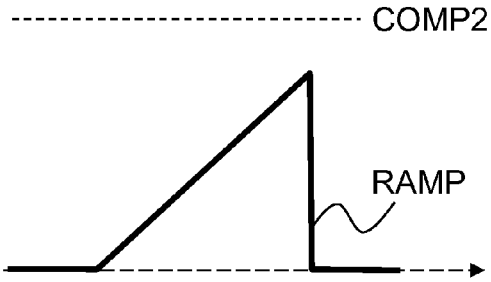
Figure 5C:
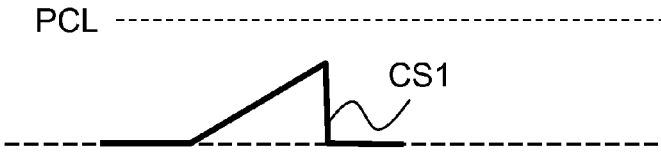

FIGS. 5A-5E show schematic diagrams of waveforms of signals in the PWM mode and the constant current mode. As shown in FIG. 5A and as described in the above, the rectified dimming current Ir2' is divided to a PWM mode period and a constant mode period in one AC period. In the PWM mode period, the level of the rectified dimming current Ir2' is decided by the PWM signal. As shown in FIGS. 5B and 5C, the level of the error amplified signal COMP1 is relatively lower, so an intersection of the error amplified signal COMP1 and the ramp signal RAMP occurs before the current sense signal CS1 reaches the predetermined current threshold PCL, and therefore, the reset signal R is determined by the intersection of the error amplified signal COMP1 and the ramp signal RAMP, and the duty of the operation signal GT is determined accordingly. The operation signal GT turns ON the power switch Q1 for a period of time to form the signal waveform of the rectified dimming current Ir2' in the PWM mode period.

Figure 5E:
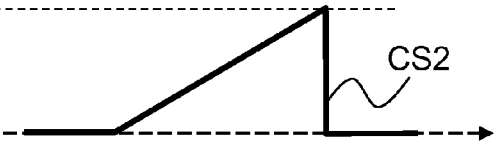
Figure 6A:
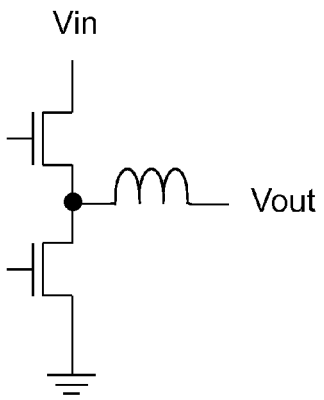
FIGS. 6A-6K show synchronous and asynchronous buck, boost, inverting, buck-boost, inverting-boost, and flyback power stage circuits.
Figure 6B:
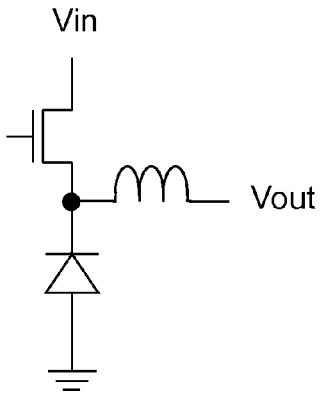
Figure 6C:
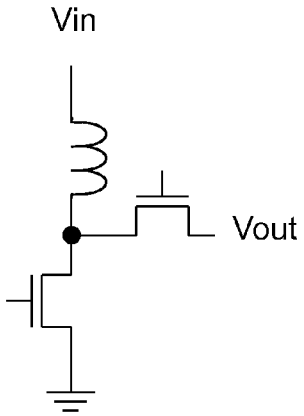
Figure 6D:
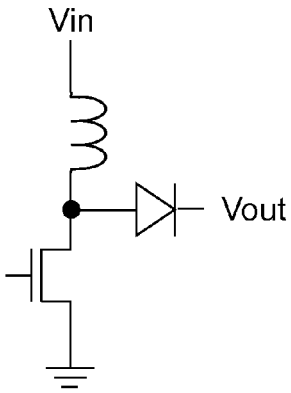
Figure 6E:
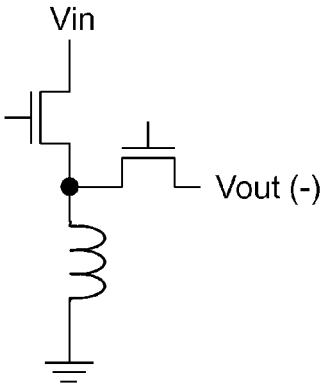
Figure 6F:
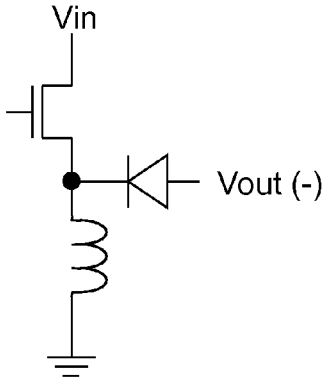
Figure 6G:
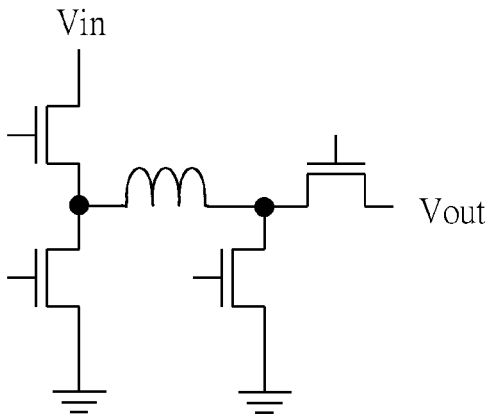
Figure 6H:
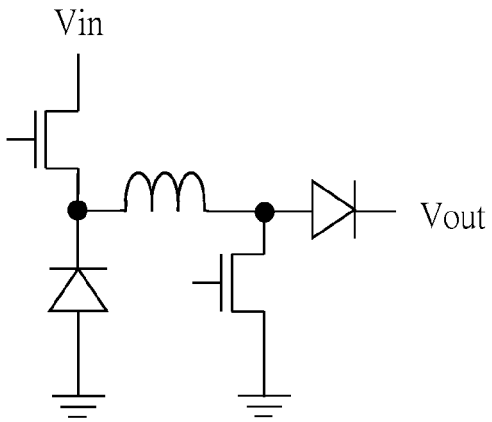
Figure 6I:
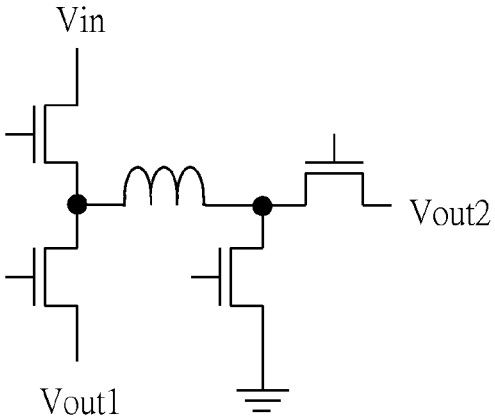
Figure 6J:
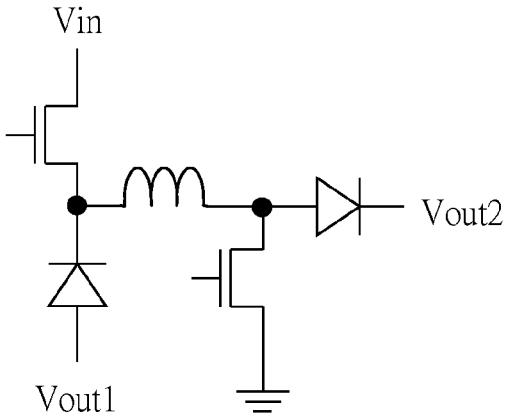
Figure 6K:
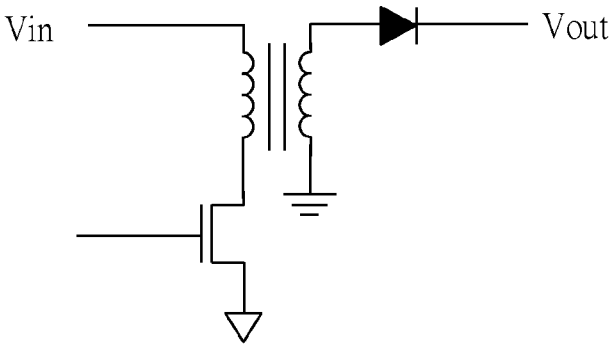

On the other hand, in the constant current mode period, the level of the rectified dimming current Ir2' is decided by the CL signal. As shown in FIGS. 5D and 5E, the level of the error amplified signal COMP2 is relatively higher, so the current sense signal CS2 reaches the predetermined current threshold PCL before an intersection of the error amplified signal COMP2 and the ramp signal RAMP occurs, and therefore, the reset signal R is determined by the CL signal, and the duty of the operation signal GT is determined accordingly. The operation signal GT turns ON the power switch Q1 for a period of time to form the signal waveform of the rectified dimming current Ir2' in the constant current mode period.

The present invention does not need a bleeder circuit, so the wasted power and manufacturing cost of the prior art bleeder circuit can be saved. Besides, note that according to the present invention, the rectified dimming current Ir2' is maintained higher than the holding current in the whole ON phase period ONPP, so the present invention can achieve full phase dimming (that is, the trigger phase can be very late). Besides, compared to the prior art, the present invention can control an integration of a current flowing through the light emitting device at a relatively lower value, so the dimmable brightness of the light emitting device circuit can be lower. The above shows that the present invention is advantageous over the prior art.

The present invention has been described in considerable detail with reference to certain preferred embodiments thereof. It should be understood that the description is for illustrative purpose, not for limiting the scope of the present invention. Those skilled in this art can readily conceive variations and modifications within the spirit of the present invention. For example, a device which does not substantially influence the primary function of a signal can be inserted between two devices shown in direction connection in the shown embodiments, such as a switch or the like, so the term "couple" should include direct and indirect connections. For another example, the light emitting device that is applicable to the present invention is not limited to the LED as shown and described in the embodiments above, but may be any current-control device. For another example, inverted and non-inverted input terminals of the error amplifier circuit and the comparison circuit are interchangeable, with corresponding amendments of the circuits processing these signals. For another example, when an external signal (such as the feedback signal or the current sense signal) is inputted to the control circuit to be processed or used for operation, the external signal can be subjected to a voltage-to-current conversion, a current-to-voltage conversion, or a ratio conversion, etc. before or after being inputted to the control circuit; and thus the "feedback signal" or "current sense signal" described in the present invention, is not limited to the "feedback signal" or "current sense signal" itself, but can be a related signal after processed by the aforementioned one or more conversions. In view of the foregoing, the spirit of the present invention should cover all such and other modifications and variations, which should be interpreted to fall within the scope of the following claims and their equivalents.

What is claimed is:

1. A light emitting device driver circuit for driving a light emitting device circuit according to a rectified dimming signal, wherein a phase-cut dimming circuit converts an AC signal to an AC dimming signal, and a rectifier circuit converts the AC dimming signal to the rectified dimming signal, the light emitting device driver circuit comprising:

a power stage circuit, which is coupled to the rectifier circuit, for operating at least one power switch therein according to an operation signal, to convert the rectified dimming signal to an output signal, for driving the light emitting device circuit; and a control circuit, for generating the operation signal according to a current sense signal related to a current flowing through the power switch, and a feedback signal related to the output signal, the control circuit including:

a pulse width modulation (PWM) circuit, for generating a PWM signal according to a level of the feedback signal;

a current limit (CL) circuit, for generating a CL signal according to the current sense signal and a predetermined current threshold, wherein the CL signal indicates whether the current sense signal reaches the predetermined current threshold; and a determination circuit, which is coupled to the PWM circuit and the CL circuit, for generating the operation signal, and determining a duty of the operation signal according to one of the PWM signal and the CL signal;

wherein the power stage circuit operates the power switch according to the operation signal, to maintain an absolute level of an AC dimming current not lower than a holding current in an ON phase period;

wherein the operation signal is generated for a plurality of times in the ON phase period, wherein the duty of the operation signal in a portion of the times is decided by the PWM signal, and the duty of the operation signal in another portion of the times is determined by the CL signal;

wherein the AC dimming signal includes the AC dimming current flowing through the phase-cut dimming circuit, and the phase-cut dimming circuit blocks an OFF phase period of the AC signal and retains the ON phase period of the AC signal, to generate the AC dimming signal.

2. The light emitting device driver circuit of claim 1, wherein the determination circuit includes:

a logic gate circuit, which is coupled to the PWM circuit and the CL circuit, for generating a reset signal according to the PWM signal and the CL signal; and a flip-flop circuit, which is coupled to the logic gate circuit, for generating the control signal according to the reset signal and a set signal, wherein the set signal is related to a clock signal or the feedback signal;

wherein a start time point of the duty of the operation signal is determined by the set signal, and an end time point of the duty of the operation signal is determined by the reset signal.

3. The light emitting device driver circuit of claim 1, wherein the PWM circuit includes:

an error amplifier circuit, for generating an error amplified signal according to the feedback signal and a reference signal; and a comparison circuit, which is coupled to the error amplifier circuit, for generating the PWM signal according to the error amplified signal and a ramp signal.

4. The light emitting device driver circuit of claim 1, which is not connected to a bleeder circuit in parallel, wherein the bleeder circuit is for consuming a bleeding current which does not flow through the light emitting device circuit to maintain the absolute level of the AC dimming current not lower than the holding current in the ON phase period.

5. The light emitting device driver circuit of claim 1, wherein the current limit (CL) signal is for maintaining the absolute level of the AC dimming current not lower than the holding current in the ON phase period.

6. The light emitting device driver circuit of claim 1, wherein the power stage circuit includes:

a first winding, which is coupled to the rectifier circuit and the power switch, for receiving the rectified dimming signal and determining a switch current flowing through the power switch according to an operation of the power switch;

a second winding, which is coupled to the first winding, for generating the output signal according to the rectified dimming signal and the switch current, the output signal being provided to the light emitting device circuit; and a third winding, which is coupled to the second winding, for generating a sense signal according to the output signal.

7. The light emitting device driver circuit of claim 6, wherein the first winding and the second winding are connected in series, to form a tapped inductor.

8. The light emitting device driver circuit of claim 6, wherein the power stage circuit further includes a voltage divider circuit, which is coupled to the third winding, for obtaining a divided voltage of the sense signal to generate the feedback signal.

9. A control method of a light emitting device driver circuit, wherein the light emitting device driver circuit is for driving a light emitting device circuit according to a rectified dimming signal, wherein a phase-cut dimming circuit converts an AC signal to an AC dimming signal, and a rectifier circuit converts the AC dimming signal to the rectified dimming signal, the control method comprising:

operating at least one power switch according to an operation signal, to convert the rectified dimming signal to an output signal for driving the light emitting device circuit, and to maintain an absolute level of an AC dimming current not lower than a holding current in an ON phase period;

generating a PWM signal according to a level of a feedback signal related to the output signal;

generating a current limit (CL) signal according to a current sense signal and a predetermined current threshold, the current sense signal being related to a current flowing thorough the power switch, wherein the CL signal indicates whether the current sense signal reaches the predetermined current threshold; and generating the operation signal according to the PWM signal and the CL signal, and determining a duty of the operation signal according to one of the PWM signal and the CL signal;

wherein the operation signal is generated for a plurality of times in the ON phase period, wherein the duty of the operation signal in a portion of the times is decided by the PWM signal, and the duty of the operation signal in another portion of the times is determined by the CL signal;

wherein the AC dimming signal includes the AC dimming current flowing through the phase-cut dimming circuit, and the phase-cut dimming circuit blocks an OFF phase period of the AC signal and retains the ON phase period of the AC signal, to generate the AC dimming signal.

10. The control method of claim 9, wherein the step of generating the operation signal according to the PWM signal and the CL signal includes:

generating a reset signal by performing a logic operation of the PWM signal and the CL signal; and inputting the reset signal and a set signal to a flip-flop circuit, to generate the control signal, wherein the set signal is related to a clock signal or the feedback signal;

wherein a start time point of the duty of the operation signal is determined by the set signal, and an end time point of the duty of the operation signal is determined by the reset signal.

11. The control method of claim 9, wherein the step of generating a PWM signal according to a level of a feedback signal related to the output signal includes:

comparing the feedback signal and a reference signal, or a signal related to the feedback signal and a reference signal, to generate an error amplified signal; and comparing the error amplified signal and a ramp signal to generate the PWM signal.

12. The control method of claim 9, wherein the current limit (CL) signal is for maintaining the absolute level of the AC dimming current not lower than the holding current in the ON phase period.

13. A control circuit of a light emitting device driver circuit, wherein the light emitting device driver circuit is for driving a light emitting device circuit according to a rectified dimming signal, wherein a phase-cut dimming circuit converts an AC signal to an AC dimming signal, and a rectifier circuit converts the AC dimming signal to the rectified dimming signal, wherein the light emitting device driver circuit includes a power stage circuit and the control circuit, wherein the power stage circuit is coupled to the rectifier circuit, for operating at least one power switch therein according to an operation signal, to convert the rectified dimming signal to an output signal, for driving the light emitting device circuit, the control circuit generating the operation signal according to a current sense signal and a feedback signal, wherein the current sense signal is related to a current flowing through the power switch, and the feedback signal is related to the output signal, the control circuit comprising:

a pulse width modulation (PWM) circuit, for generating a PWM signal according to a level of the feedback signal;

a current limit (CL) circuit, for generating a CL signal according to the current sense signal and a predetermined current threshold, wherein the CL signal indicates whether the current sense signal reaches the predetermined current threshold; and a determination circuit, which is coupled to the PWM circuit and the CL circuit, for generating the operation signal, and determining a duty of the operation signal according to one of the PWM signal and the CL signal;

wherein the power stage circuit operates the power switch according to the operation signal, to maintain an absolute level of an AC dimming current not lower than a holding current in an ON phase period;

wherein the operation signal is generated for a plurality of times in the ON phase period, wherein the duty of the operation signal in a portion of the times is decided by the PWM signal, and the duty of the operation signal in another portion of the times is determined by the CL signal;

wherein the AC dimming signal includes the AC dimming current flowing through the phase-cut dimming circuit, and the phase-cut dimming circuit blocks an OFF phase period of the AC signal and retains the ON phase period of the AC signal, to generate the AC dimming signal.

14. The control circuit of claim 13, wherein the determination circuit includes:

a logic gate circuit, which is coupled to the PWM circuit and the CL circuit, for generating a reset signal according to the PWM signal and the CL signal; and a flip-flop circuit, which is coupled to the logic gate circuit, for generating the control signal according to the reset signal and a set signal, wherein the set signal is related to a clock signal or the feedback signal;

wherein a start time point of the duty of the operation signal is determined by the set signal, and an end time point of the duty of the operation signal is determined by the reset signal.

15. The control circuit of claim 13, wherein the PWM circuit includes:

an error amplifier circuit, for generating an error amplified signal according to the feedback signal and a reference signal; and a comparison circuit, which is coupled to the error amplifier circuit, for generating the PWM signal according to the error amplified signal and a ramp signal.

16. The control circuit of claim 13, wherein the light emitting device driver circuit is not connected to a bleeder circuit in parallel, wherein the bleeder circuit is for consuming a bleeding current which does not flow through the light emitting device circuit to maintain the absolute level of the AC dimming current not lower than the holding current in the ON phase period.

17. The control circuit of claim 13, wherein the current limit (CL) signal is for maintaining the absolute level of the AC dimming current not lower than the holding current in the ON phase period.

* * * * *